US006564512B1

(12) United States Patent
Whittemore

(10) Patent No.: US 6,564,512 B1
(45) Date of Patent: May 20, 2003

(54) MOUNT FOR AIR MOVING DEVICE

(75) Inventor: Jeffrey P. Whittemore, Arlington, MA (US)

(73) Assignee: Zipwall LLC, Arlington, MA (US)

( * ) Notice: Subject to any disclaimer, the term of this patent is extended or adjusted under 35 U.S.C. 154(b) by 0 days.

(21) Appl. No.: 10/056,325

(22) Filed: Jan. 24, 2002

Related U.S. Application Data

(60) Provisional application No. 60/264,393, filed on Jan. 26, 2001.

(51) Int. Cl.[7] ..... E04G 3/08

(52) U.S. Cl. ..... 52/37; 52/127.2; 52/DIG. 12; 248/694; 454/212

(58) Field of Search ..... 52/DIG. 12, 127.2, 52/37; 454/196, 200, 211, 212, 213, 214; 248/694

(56) References Cited

U.S. PATENT DOCUMENTS

| | | | | |
|---|---|---|---|---|
| 2,493,123 A | | 1/1950 | Essick | |
| 2,532,590 A | * | 12/1950 | Anasstasi | |
| 3,096,933 A | | 7/1963 | Bora | |
| 4,081,915 A | * | 4/1978 | Babcerowicz et al. | 34/235 |
| 4,334,461 A | * | 6/1982 | Ferguson et al. | 98/119 |
| 4,756,728 A | | 7/1988 | Conrad | |
| 4,883,512 A | | 11/1989 | Griffis | |
| 4,902,315 A | | 2/1990 | Spicer | |
| 4,922,806 A | | 5/1990 | Newman et al. | |
| 5,031,516 A | | 7/1991 | Jacobson | |
| 5,148,552 A | * | 9/1992 | Kress et al. | 4/252.2 |
| 5,338,252 A | * | 8/1994 | Bowler et al. | 454/155 |
| 5,558,112 A | | 9/1996 | Strieter | |
| 5,702,296 A | | 12/1997 | Grano | |
| 5,809,936 A | | 9/1998 | Wall | |

* cited by examiner

*Primary Examiner*—Carl D. Friedman
*Assistant Examiner*—Yvonne M. Horton
(74) *Attorney, Agent, or Firm*—Mills & Onello, LLP

(57) ABSTRACT

A mounting system includes a temporary panel that can be quickly and easily installed at an installation site, for example a window, for rapid installation of an air moving system. The mounting system provides a barrier to the reentry of evacuated construction dust and fumes, and can be assembled and disassembled without damage of the installation site. In one embodiment, the present invention is directed a mount for an air moving apparatus. The mount comprises a panel having an aperture. A strap communicates with, and extends from the panel. An elongated brace also communicates with the strap. A locking mechanism fixes the length of the strap between the panel and the brace. Multiple straps and braces may be employed for securing the panel to the installation site. Expansion panels allow for the panel width or height to be adjustable to cover a range of installation site configurations.

41 Claims, 4 Drawing Sheets

MOUNT FOR AIR MOVING DEVICE

RELATED APPLICATIONS

This application claims the benefit of U.S. Provisional Application Ser. No. 60/264,393, filed Jan. 26, 2001.

BACKGROUND OF THE INVENTION

At construction sites, it is often times desirable to prevent dust or fumes that are generated from entering other regions of a building or room. To prevent dust or fumes from escaping the work zone, negative air pressure can be generated in the work zone. To accomplish this, air movers, for example fans, are utilized to generate a flow of air out of the room, for example through a nearby window. The air mover can be mounted to the window itself, or a temporary duct can be fixed to an air mover stationed elsewhere in the room, and the duct mounted through the window opening to provide a path for the escape of air out of the work zone. The air moving devices can include a filter system for filtering the displaced air.

In either case, an air flow barrier must be placed about the window-mounted air mover or window-mounted duct in order to prevent the removed air from reentering the work zone. The process of mounting the air mover or duct can be time consuming and damaging to the window or nearby walls. For example, the air mover or duct can be mounted to the window opening using plastic sheeting and duct tape. The plastic sheeting is cut to the size of the opening, and then secured to the window and frame using duct tape. An opening is then cut in the sheeting, and the air mover or air duct is inserted in the opening and the interface is sealed by duct tape. Alternatively, a customized plywood panel can be cut to fit the window opening, and secured to the window frame using nails or screws. The use of nails, screws, and duct tape results in damage that must be repaired at the completion of the project to avoid permanently defacing the installation site.

SUMMARY OF THE INVENTION

The present invention is directed to a mounting system whereby a temporary panel can be quickly and easily installed at an installation site, for example a window, for rapid installation of an air moving system. The mounting system provides a barrier to the reentry of evacuated construction dust and fumes, and can be assembled and disassembled without damage of the installation site.

In a first aspect, the present invention is directed a mount for an air moving apparatus. The mount comprises a panel having an aperture. A strap communicates with, and extends from the panel. An elongated brace also communicates with the strap. A locking mechanism fixes the length of the strap between the panel and the brace.

In one embodiment, the strap comprises an elastic band. Alternatively, the strap may comprise a band of fixed length, and the locking mechanism comprises a ratchet mechanism for receiving the distal end of the strap, and for ratchetably tensioning the strap between the panel and the brace. The strap may be slidably mounted relative to the panel and/or brace.

The locking mechanism preferably comprises a spring-loaded clamp having a surface configured to interface with the a body portion of the strap.

The aperture may be configured to receive air moving apparatus, including, for example, an air duct or air moving device. The panel is preferably formed of an airtight material, for example plastic, Masonite™, or pressboard.

A friction material may be provided at an edge of the panel for preventing the panel from slipping relative to the installation site.

An expansion panel may be provided to effectively extend the height or width of the main panel. The expansion panel may include an expansion panel strap communicating with the expansion panel and extending from the expansion panel; an elongated expansion panel brace for communicating with a distal end of the expansion panel strap; and an expansion panel locking mechanism for fixing the length of the expansion panel strap between the expansion panel and the expansion panel brace. The expansion panel may have a linear, or offset, profile.

A friction material may be provided at an edge of the expansion panel for preventing the expansion panel from slipping relative to the main panel, other expansion panels, and/or the installation site.

The strap may pass through an opening in the brace, such that the strap slidably communicates with the brace, and may pass through an opening in the panel, such that the strap slidably communicates with the panel. The brace may be laterally flexible.

The strap may comprise a rigid member, in which case, the rigid member is longitudinally spring-loaded at one of the panel and brace, and the locking mechanism is preferably mounted to the other of the panel and brace for receiving a locking end of the rigid member.

A closure panel may be provided including a closure panel strap communicating with the closure panel and extending from the closure panel; an elongated closure panel brace for communicating with the closure panel strap; and a closure panel locking mechanism for fixing the length of the closure panel strap between the closure panel and the closure panel brace, the closure panel having an outer perimeter larger than the perimeter of the aperture.

The strap may comprise multiple straps, the brace may comprise multiple braces, and the locking mechanism may comprise multiple locking mechanisms.

In another aspect, the present invention is directed to a system for mounting an air moving apparatus. The system comprises a panel having an aperture. First and second straps each communicate with the panel and each extend from the panel. First and second elongated braces communicate with the first and second straps respectively. First and second locking mechanisms fix the respective lengths of the first and second straps between the panel and the first and second braces.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1A:
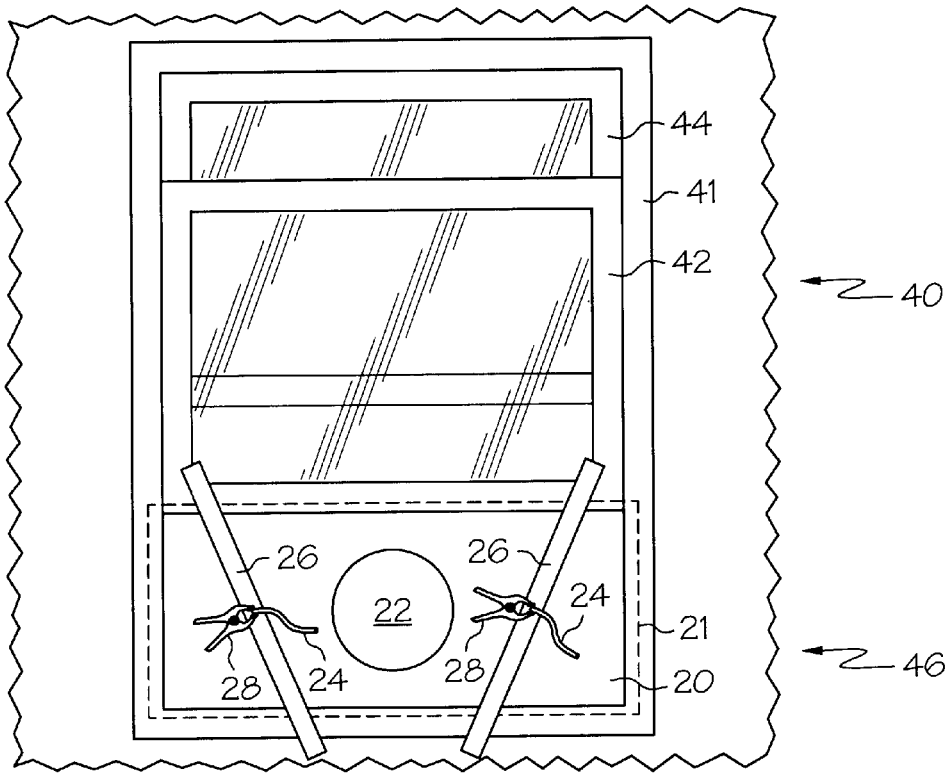
FIG. 1A is an illustration of the window panel of the present invention as mounted in a standard window, in accordance with the present invention.

FIG. 1A is an illustration of the window panel of the present invention as mounted in a standard window. The window 40 includes an upper portion 44 and a lower portion 42 that are slidable relative to the window frame 41. The lower portion 42 is raised to provide a window opening 46. In this case, the window opening is rectangular in shape, but other configurations are possible and equally applicable to the present invention. A window panel 20 in accordance with the present invention is placed at one side of the window 40, for example at an external surface of the window 40. The perimeter 21 of the window panel 20 is slightly larger than the window opening, for example slightly larger in height, width, or height and width. Straps 24 extend from the body of the panel 20 and communicate with braces 26. The braces 26 are elongated so as to have a length that is greater than the height, width, or height and width of the window opening 46. The straps 24 are tensioned between the panel 20 and braces 26. A clamp 28, or other locking mechanism, maintains the tension of the strap 24 between the panel 20 and the braces 26. In this manner, the tension in the straps 24 secures the panel 20 and braces 26 relative to each other, and relative to the window opening 46.

Figure 1B:
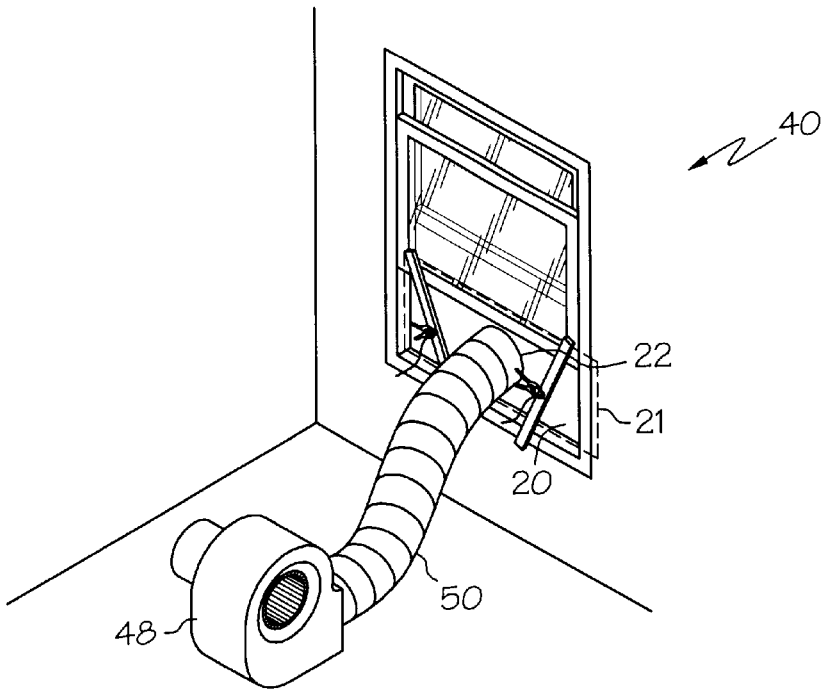
FIG. 1B is an illustration of the window panel of the present invention installed in a room in a system with and having an air moving device and air duct.

An aperture 22 is provided in the panel 20 to allow for the mounting of an air moving device or air duct at the panel 20. With reference to FIG. 1B, a window panel 20 is installed at a window 40 in a room. An air moving device 40 is coupled to a first end of an air duct 50. The air duct 50 may comprise a flexible, aluminum or plastic air duct, as commonly employed in the field. The second end of the air duct 50 is placed through the aperture 22 in the panel 20. The aperture 22 may be circular as shown to accommodate an air duct 50 having a circular cross section. The diameter of the aperture 22 may be slightly less than the outer diameter of the air duct 50 such that the air duct 50 can be slightly compressed and secured in the aperture 22 with relative ease.

Figure 2:
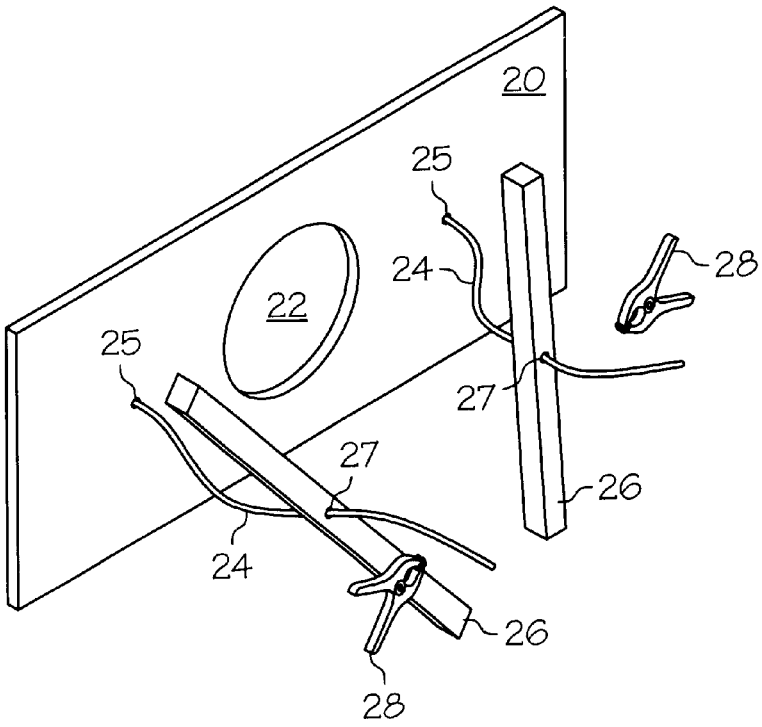
FIG. 2 is a perspective view of the window panel of the present invention.

FIG. 2 illustrates an embodiment of the present invention, illustrating its primary components. The panel 20 preferably comprises a reinforced, structurally rigid panel. For example, the panel 20 may comprise plastic, Masonite™, or pressboard materials. The panel 20 preferably has the advantageous characteristics of being lightweight, and rigid, thin such that the panel 20 is easy to work with, and further air tight such that any air that is evacuated through the aperture 22 does not reenter the work zone through the panel body 20. The panel 20 may be configured in a number of geometries, including, for example, rectangular and square, and the aperture 22 and straps may be positioned at any appropriate location on the panel.

Tensioning straps 24 are mounted to the panel body 20. The tensioning straps 24 may be mounted to either face of the panel body 20, in a fixed, or slidable relationship relative to the panel 20. In one embodiment, the tensioning straps 24 comprise elastic bands, for example burgee cords that pass through small openings 25 in the panel body 20 and are knotted, or otherwise secured, to the panel body 20 at their proximal ends. Distal ends of the straps 24 communicate with braces 26, in a fixed, or slidable relationship. In one embodiment, the straps 24 pass through openings 27 in the braces 26 in a slidable relationship. Spring-loaded clamps 28 are adapted to clamp body portions of the straps 24 such that when the panel 20 is mounted, the straps 24 can be tensioned between the panel 20 and the braces 26. The tension is maintained by the locking action of the clamp 28. The clamps 28 may comprise, for example, spring-loaded jaw clamps, as shown in FIG. 2, or may comprise popular spring-loaded push button clamps as shown in FIG. 4B. Alternatively, the clamp, or locking mechanism, may be incorporated into the body of the brace, for example as a spring-loaded push-button clamp, or as a tapered groove that captures the body of the strap.

The braces 26 are elongated in a longitudinal direction, and are of a suitable length such that they can be placed across the window opening 46 when mounted. The braces 26 may be placed horizontally, vertically, or angularly, across the window opening. The braces 26 may comprise, for example, wood, plastic, aluminum, fiberglass, or graphite members having for example, a round or rectangular cross section. The braces 26 may be laterally flexible such that when the straps 24 are tensioned, the flexibility, or play, in the braces 26 imparts further rigidity to the installation.

In another embodiment, the straps 24 may comprise a longitudinally inelastic strap or member. In this case, inherent flexibility in the braces 26 operating in conjunction with the clamps 28 would provide sufficient play for generating sufficient friction between the braces 26 and the installation site, for example the window frame, for securing the panel 20 in place. Alternatively, the inelastic strap 24 or rigid member may be longitudinally spring-loaded at the panel 20 or the brace 26 to provide for longitudinal play sufficient for securing the panel 20 and braces 26.

In another embodiment, a racheting mechanism may be employed to tension the strap 24 between the panel 20 and the braces 26. In this case, a distal end of the tensioning strap 24 would be placed through a racheting crank mounted at either the braces 26 or the panel 20 which, when cranked, rachetably tensions the strap 24.

Figure 3:
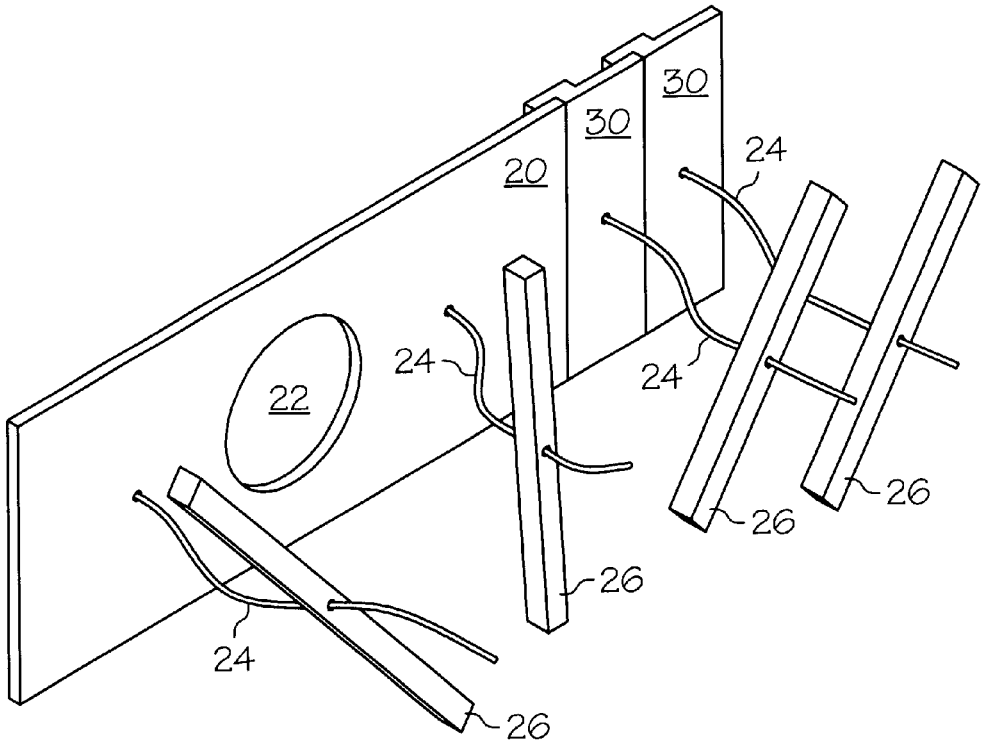
FIG. 3 is a perspective view of the window panel of FIG. 2, including expansion panels in accordance with the present invention.

With reference to FIG. 3, in another embodiment, the system of the present invention includes modular expansion panels 30 mounted alongside the main panel 20 to extend its width and/or length such that the panel 20 can deployed in window openings greater in expanse than the height, or width of the main panel 20. The expansion panels 30 are preferably formed of a height that is consistent with the height of the main panel, or of a width that is consistent with the width of the main panel 20. At least one strap 24 is mounted to the body of the expansion panel 30, and at least one brace 26 communicates with the at least one strap 24 for mounting the expansion panel 30 to the window opening, in the manner described above.

Figure 4A:
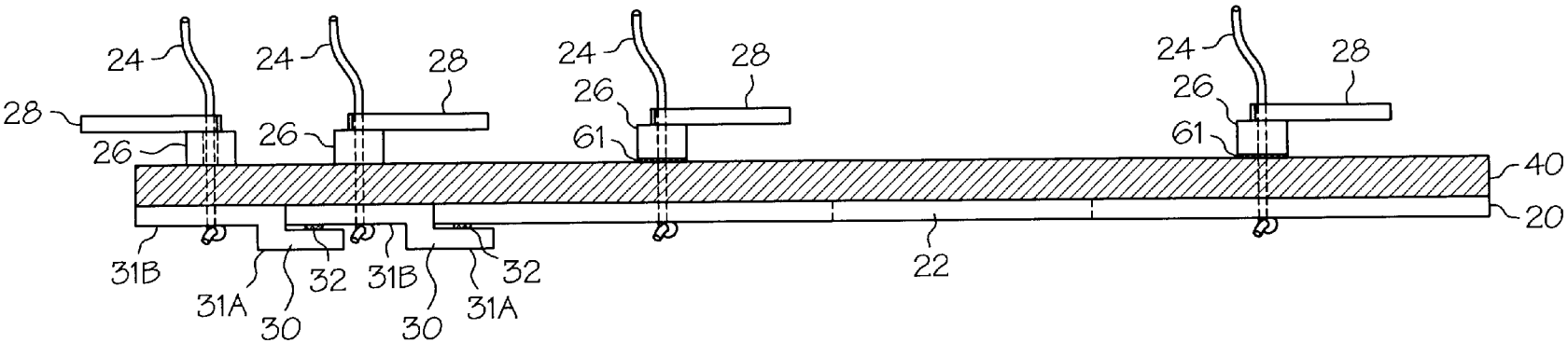
FIGS. 4A and 4B are top views of the installed window panel including first and second embodiments of expansion panels respectively, in accordance with the present invention.
Figure 4B:
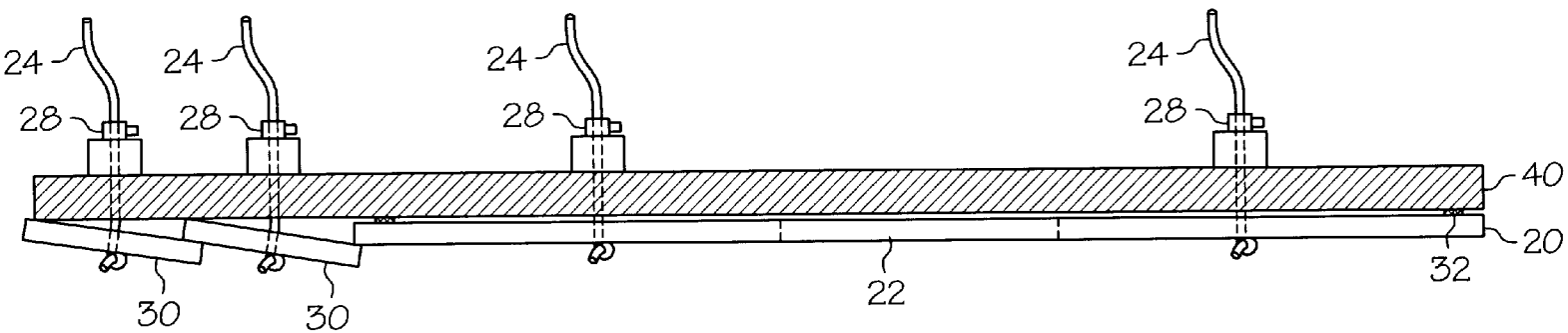

FIG. 4A is a top view of an installed window panel 20 including a first embodiment of the expansion panel 30, in accordance with the present invention. The main panel 20, including aperture 22 is mounted across the window opening on one side of a window frame 40. A strap 24 extends between the panel 20 and a brace 26 mounted to an opposite side of the window frame 40, and are longitudinally tensioned by jaw clamp 28 to frictionally secure the panel 20 and braces 26 in place. The expansion panels 30 are similarly mounted in place with braces 26. The expansion panels 30 have an offset cross section such that first and second leg portions 31A, 31B of each expansion panel 30 rest flat relative to the adjacent main panel 20 and adjacent expansion panels 30. A friction material 32 may be provided along edges of the expansion panels 30 to prevent sliding of the expansion panels 30 relative to each other, and relative to the main panel 20 and window frame 40. Friction material 61 may also be provided along a surface of the braces 26, to prevent sliding of the braces 26 relative to the window frame 40.

In the cross-sectional top view of FIG. 4B, the main panel 20 includes a friction material 32 along its edges to prevent the main panel 20 from sliding relative to the window frame 40. Push-button type clamps 28 are employed for clamping the tensioned straps 24. Expansion panels 30 having a linear, flat cross section are employed, and are shown in position, resting at an angle with respect to the window frame 40, in this exaggerated view.

Figure 5:
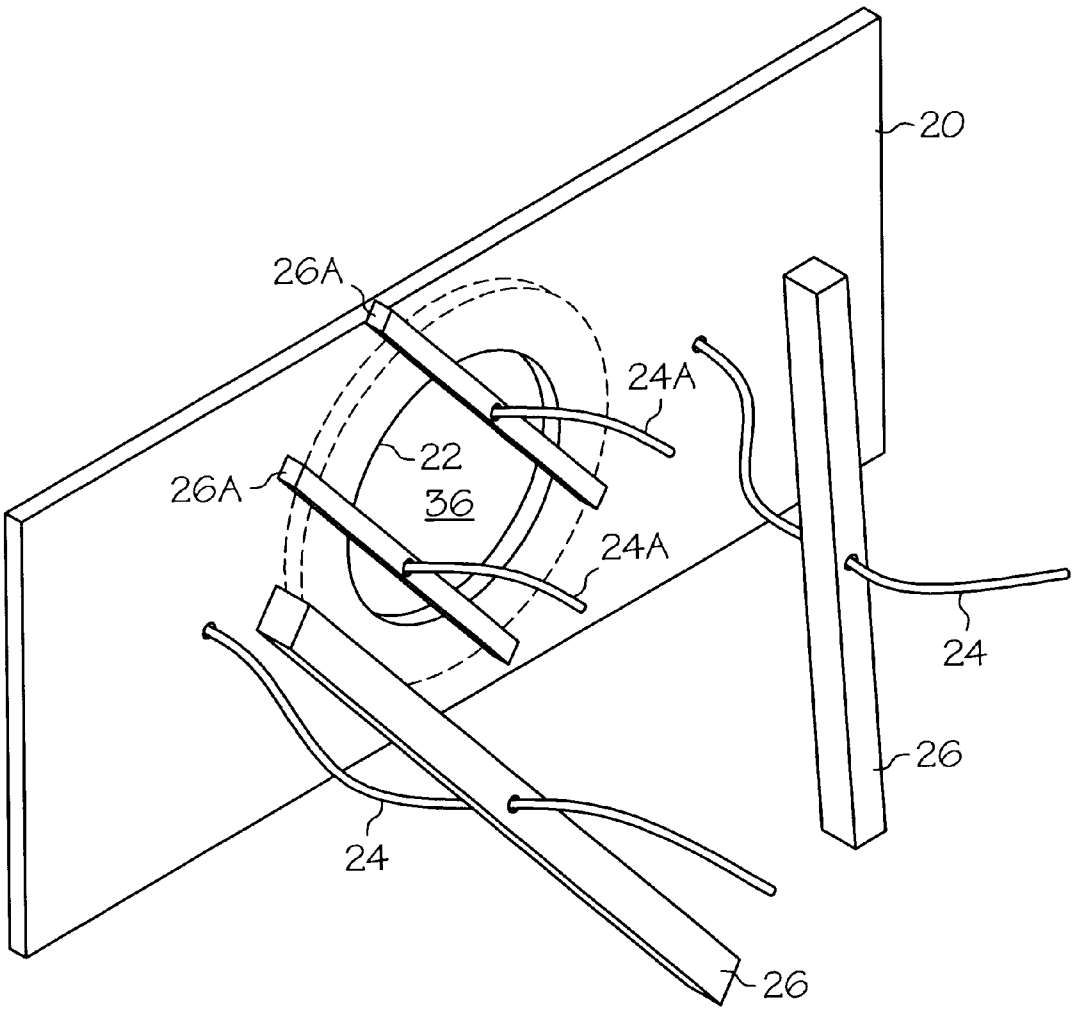
FIG. 5 is a perspective view of a window panel illustrating the use of a secondary panel for blocking the aperture when the air moving apparatus coupled to the window panel is not in use in accordance with the present invention.

FIG. 5 is a perspective view of the system of the present invention illustrating the use of a secondary, closure panel 36 for blocking the aperture 22, for example when the air moving apparatus coupled to the window panel 20 is not in use. In this embodiment, the closure panel 36 is of an outer diameter that is larger than the diameter of the aperture 22. Closure straps 24A extend from the closure panel 36 and interface with closure brackets 26A for securing the closure panel 36 in place with respect to the main panel 20 in the same manner that the main panel 20 is secured in place relative to the window frame. In this manner, outside air can be prevented from entering the work zone when the air moving device is not in use.

While this invention has been particularly shown and described with references to preferred embodiments thereof, it will be understood by those skilled in the art that various changes in form and details may be made herein without departing from the spirit and scope of the invention as defined by the appended claims.

For example, while the mount and system of the present invention are described above as being suitable for installation at a window opening, the present invention is equally applicable to installation at other types of openings, for example an opening in a wall, ceiling or floor of a room.

I claim:

1. A mount for air moving apparatus, comprising a panel having an aperture;

a strap communicating with the panel and extending from the panel;

an elongated brace communicating with the strap; and a locking mechanism for fixing the length of the strap between the panel and the brace.

2. The mount of claim 1 wherein the strap comprises an elastic band.

3. The mount of claim 1 wherein the locking mechanism comprises a ratchet mechanism for receiving the distal end of the strap, and for ratchetably tensioning the strap between the panel and the brace.

4. The mount of claim 1 wherein the strap is slidable relative to the panel.

5. The mount of claim 1 wherein the strap is slidable relative to the brace.

6. The mount of claim 1 wherein the aperture is configured to receive air moving apparatus.

7. The mount of claim 1 wherein the aperture is configured to receive an air duct or air moving device.

8. The mount of claim 1 wherein the panel comprises an airtight material.

9. The mount of claim 9 wherein the panel comprises a material selected form the group of materials consisting of plastic, Masonite™, and pressboard.

10. The mount of claim 1 further comprising a friction material at an edge of the panel.

11. The mount of claim 1 further comprising an expansion panel including an expansion panel strap communicating with the expansion panel and extending from the expansion panel; an elongated expansion panel brace communicating with a distal end of the expansion panel strap; and an expansion panel locking mechanism for fixing the length of the expansion panel strap between the expansion panel and the expansion panel brace.

12. The mount of claim 11 wherein the expansion panel is sized to extend a width or a height of the panel when mounted adjacent the panel.

13. The mount of claim 11 wherein the expansion panel has a linear profile.

14. The mount of claim 11 wherein the expansion panel has an offset profile.

15. The mount of claim 11 further comprising a friction material at an edge of the expansion panel.

16. The mount of claim 1 wherein the strap passes through an opening in the brace, such that the strap slidably communicates with the brace.

17. The mount of claim 1 wherein the strap passes through an opening in the panel, such that the strap slidably communicates with the panel.

18. The mount of claim 1 wherein the brace is laterally flexible.

19. The mount of claim 1 wherein the strap comprises a rigid member.

20. The mount of claim 19 wherein the rigid member is spring-loaded on one of the panel and brace, and wherein the locking mechanism is mounted to the other of the panel and brace for receiving a locking end of the rigid member.

21. The mount of claim 1 wherein the locking mechanism comprises a spring-loaded clamp having a surface configured to interface with the a body portion of the strap.

22. The mount of claim 1 further comprising a closure panel including a closure panel strap communicating with the closure panel and extending from the closure panel; an elongated closure panel brace for communicating with a distal end of the closure panel strap; and a closure panel locking mechanism for fixing the length of the closure panel strap between the closure panel and the closure panel brace, the closure panel having an outer perimeter larger than the perimeter of the aperture.

23. The mount of claim 1 wherein the strap comprises multiple straps, wherein the brace comprises multiple braces, and wherein the locking mechanism comprises multiple locking mechanisms.

24. The mount of claim 1 wherein the locking mechanism is integral with the brace.

25. A system for mounting air moving apparatus, comprising a panel having an aperture;

a first and second straps, each communicating with the panel and each extending from the panel;

first and second elongated braces for communicating with distal ends of the first and second straps respectively; and first and second locking mechanisms for fixing the lengths of the first and second straps respectively between the panel and the first and second braces respectively.

26. The system of claim 25 wherein the first and second straps comprise elastic bands.

27. The system of claim 25 wherein the first and second locking mechanisms each comprise a ratchet mechanism for receiving the distal end of the respective strap, and for ratchetably tensioning the strap between the panel and the respective brace.

28. The system of claim 25 wherein the first and second straps are slidable relative to the panel.

29. The system of claim 25 wherein the first and second straps are slidable relative to the brace.

30. The system of claim 25 wherein the aperture is configured to receive air moving apparatus.

31. The system of claim 25 wherein the aperture is configured to receive an air duct or air moving device.

32. The system of claim 25 further comprising an expansion panel including an expansion panel strap communicating with the expansion panel and extending from the expansion panel; an elongated expansion panel brace for communicating with the expansion panel strap; and an expansion panel locking mechanism for fixing the length of the expansion panel strap between the expansion panel and the expansion panel brace.

33. The system of claim 32 wherein the expansion panel is sized to extend a width or a height of the panel when mounted adjacent the panel.

34. The system of claim 25 wherein the first and second straps each pass through openings in the first and second braces, such that the first and second straps slidably communicate with the braces.

35. The system of claim 25 wherein the first and second straps pass through openings in the panel, such that the straps slidably communicate with the panel.

36. The system of claim 25 wherein the first and second braces are laterally flexible.

37. The system of claim 25 wherein the first and second straps comprise rigid members.

38. The system of claim 37 wherein the rigid members are spring-loaded on one of the panel and braces, and wherein the locking mechanisms are mounted to the other of the panel and braces for receiving a locking end of the rigid members.

39. The system of claim 25 wherein the locking mechanisms each comprise a spring-loaded clamp having a surface configured to interface with the a body portion of the strap.

40. The system of claim 25 further comprising a closure panel including a closure panel strap communicating with the closure panel and extending from the closure panel; an elongated closure panel brace for communicating with the closure panel strap; and a closure panel locking mechanism for fixing the length of the closure panel strap between the closure panel and the closure panel brace, the closure panel having an outer perimeter larger than the perimeter of the aperture.

41. The system of claim 25 wherein the locking mechanisms are each integral with the respective brace.

* * * * *

UNITED STATES PATENT AND TRADEMARK OFFICE

CERTIFICATE OF CORRECTION

PATENT NO. : 6,564,512 B1
DATED : May 20, 2003
INVENTOR(S) : Jeffrey P. Whittemore It is certified that error appears in the above-identified patent and that said Letters Patent is hereby corrected as shown below:

Column 6,
Line 39, after "with" delete "the".
Line 58, before "first" delete "a".

Column 8,
Line 15, after "with" delete "the".

Signed and Sealed this

Twenty-second Day of July, 2003

JAMES E. ROGAN
*Director of the United States Patent and Trademark Office*